United States Patent [19]

Knapp et al.

[11] Patent Number: 4,975,146

[45] **Date of Patent: * Dec. 4, 1990**

[54] PLASMA REMOVAL OF UNWANTED MATERIAL

[75] Inventors: James H. Knapp, Gilbert; George F. Carney; Francis J. Carney, both of Tempe, all of Ariz.

[73] Assignee: Motorola Inc., Schaumburg, Ill.

[ * ] Notice: The portion of the term of this patent subsequent to Oct. 31, 2006 has been disclaimed.

[21] Appl. No.: 404,938

[22] Filed: Sep. 8, 1989

[51] Int. Cl.[5] ..... B44C 1/22; C23F 1/00; C03C 15/00; C03C 25/06

[52] U.S. Cl. ..... 156/643; 134/1; 134/2; 134/26; 156/646; 156/656; 156/655; 204/192.35

[58] Field of Search ..... 156/643, 646, 653, 655, 156/656, 657, 664; 134/1, 26, 30, 2; 204/192.32, 192.35, 192.37

[56] References Cited

U.S. PATENT DOCUMENTS

| | | | |
|---|---|---|---|
| Re. 30,505 | 2/1981 | Jacob | 156/643 |
| 4,657,616 | 4/1987 | Benzing et al. | 156/643 X |
| 4,676,866 | 6/1987 | Tang et al. | 156/643 |
| 4,764,248 | 8/1988 | Bhattacherjee et al. | 156/643 |
| 4,786,352 | 11/1988 | Benzing | 156/345 |
| 4,832,787 | 5/1989 | Bondur et al. | 156/643 |
| 4,857,140 | 8/1989 | Boewenstein | 156/653 X |
| 4,877,482 | 10/1989 | Knapp et al. | 156/643 |
| 4,878,994 | 11/1989 | Jucha | 156/643 |

*Primary Examiner*—William A. Powell
*Attorney, Agent, or Firm*—Harry A. Wolin

[57] ABSTRACT

A method fpr removing coatings from surfaces without damaging the underlying surface includes placing a surface having material to be removed thereon into a plasma reactor and exposing it to a gaseous plasma comprising a reactive halogen species. The reactive halogen species may be derived from one or more of many well known halogen gases. An optional step of cleaning the coating prior to exposure to the halogen plasma is recommended.

8 Claims, No Drawings

PLASMA REMOVAL OF UNWANTED MATERIAL

BACKGROUND OF THE INVENTION

This invention relates, in general, to a method for removing unwanted material from surfaces, and more particularly to a method of removing unwanted material from workpiece surfaces employing a gaseous plasma comprising a reactive halogen species. A related invention is disclosed by the same inventors in U.S. Patent Application Ser. No. 07/327,630, filed Mar. 23, 1989, entitled "Nitride Removal Method", now U.S. Pat. No. 4,877,482.

Various surfaces are commonly coated for decoration, protection, to improve wear characteristics and to better interact with materials that they come into contact with. However, once many coatings begin to wear , it is extremely difficult to remove the remaining coating so that the surface may be recoated. Commonly used methods of removing coatings are reverse plating, wet chemical etches and media blast removal. These methods are often detrimental in that they will not uniformly remove coatings and may also damage the underlying surface. Damage to the underlying surface will often result in a need for rework or in extreme cases where critical dimensions must be maintained, render the surface non-usable.

Various coatings exist in the art today that are not used to their fullest extent due to the absence of a method to uniformly removing coatings once they begin to wear. An example is titanium nitride. In addition to the favorable characteristics mentioned above, titanium nitride has excellent lubricity and works well in conjunction with plastics. It would be highly beneficial to employ coatings such as titanium nitride in numerous endeavors if a method were available to remove it without damaging the underlying surface.

SUMMARY OF THE INVENTION

Accordingly, it is an object of the present invention to provide a method for removing material from surfaces that does not damage the underlying surface itself.

Another object of the present invention is to provide a method for removing material from surfaces that may be performed relatively inexpensively.

It is an additional object of the present invention to provide a method for removing material from surfaces that employs dry etching techniques.

The foregoing and other objects and advantages are achieved in the present invention by one embodiment in which, as a part thereof, includes providing a surface having a material to be removed thereon, placing the surface including the material to be removed into a plasma reactor and exposing the surface to a gaseous plasma comprising a reactive halogen species.

A more complete understanding of the present invention can be attained by considering the following detailed description.

DETAILED DESCRIPTION OF THE INVENTION

Typically, it is desirable to coat surfaces with coatings such as nitrides and chromium containing materials for decoration, protection, to improve wear characteristics and to better interact with other material that the surface contacts. For example, titanium nitride coatings work extremely well on metal mold plates for use in encapsulating semiconductor devices as well as other types of tools and molds, especially tools used for punching, cutting and drilling metal and the like. In addition to coating metal, it is also desirable to coat surfaces comprising plastic, glass and ceramic. However, once the coatings have began to wear, it has been extremely difficult to remove the remaining coating from the surfaces upon which they are disposed without damaging the underlying surface.

To remove coatings from the surfaces on which they are disposed without damaging that surface, it is desirable to first clean the coating so that particles will not be disposed thereon and inhibit removal. One way in which this may be done includes first cleaning the coating with acetone followed by an isopropyl alcohol cleaning. The coating is then subjected to a methanol cleaning which leaves no residue on the coating. Finally, the coated surface is placed into a plasma reactor and is subjected to a gaseous plasma consisting of pure oxygen. One skilled in the art will understand that this cleaning sequence is merely an example and is not meant to limit the invention disclosed herein.

Once a coating has been cleaned, it is exposed to a gaseous plasma comprising a reactive halogen species. The gaseous plasma may be derived from a single halogen containing gas, a mixture of halogen containing gases or a mixture of halogen containing and non-halogen containing gases. Particularly, fluorine and chlorine containing gases have been found to work exceptionally well. Additionally, optimum results are obtained in an enclosed chamber having a chamber pressure in the range of 0.5 to 5.0 torr, a chamber temperature in the range of 40° to 100° C. and wherein the power applied to the plasma reactor is in the range of 100 to 1000 watts.

A specific example of a method for removing titanium nitride coatings from metal surfaces includes initially cleaning the titanium nitride coating in the manner disclosed above. Once the titanium nitride coating has been cleaned, the titanium nitride coated metal surface is placed into a plasma reactor having a barrel configured chamber such as a Tegal 965 plasma etcher. The chamber pressure is set to approximately 1.0 torr, the chamber temperature is approximately 80° C. and the power applied to the plasma etcher is approximately 400 watts. The gas from which the plasma is derived is a mixture comprising 91.5% $CF_4$ and 8.5% $O_2$. It should be understood that the reaction time is dependent upon the amount of coating disposed on the metal surface. The plasma containing the reactive fluorine species will not damage the underlying surface if it is removed within a reasonable amount of time following the completed removal of the titanium nitride coating.

Thus it is apparent that there has been provided, in accordance with the invention, an improved method for removing coatings from surfaces which meets the objects and advantages set forth above. While specific embodiments of the invention have been shown and described, further modifications and improvements will occur to those skilled in the art. It is desired that it be understood, therefore, that this invention is not limited to the particular forms shown and it is intended in the appended claims to cover all modifications which do not depart from the spirit and scope of this invention.

We claim:

1. A method for removing material from surfaces comprising the steps of:

providing a surface including material to be removed thereon;

cleaning said material to be removed;

placing said surface including said material to be removed into a plasma reactor; and exposing said surface to a gaseous plasma comprising a reactive halogen species.

2. The method of claim 1 wherein the surface is comprised of metal, plastic, glass or ceramic.

3. The method of claim 2 wherein the reactive halogen species includes one or more of fluorine and chlorine.

4. The method of claim 3 wherein the material to be removed comprises a nitride or a chromium containing material.

5. The method of claim 1 wherein the cleaning step comprises the steps of:

cleaning the material to be removed with acetone;

cleaning said material to be removed with isopropyl alcohol;

cleaning said material to be removed with methanol; and subjecting said material to be removed to a gaseous plasma consisting of oxygen.

6. A method for removing material from surfaces comprising the steps of:

providing a surface comprised of metal, plastic, glass or ceramic having a material to be removed thereon;

cleaning said material to be removed;

placing said surface including said material to be removed into a plasma reactor; and exposing said surface to a gaseous plasma comprising one or more of reactive fluorine and chlorine species.

7. The method of claim 6 wherein the material to be removed comprises a nitride or a chromium containing material.

8. The method of claim 7 wherein the cleaning step comprises the steps of:

cleaning the material to be removed with acetone;

cleaning said material to be removed with isopropyl alcohol;

cleaning said material to be removed with methanol; and subjecting said material to be removed to a gaseous plasma consisting of oxygen.

* * * * *